US010021948B1

(12) United States Patent
Fell

(10) Patent No.: US 10,021,948 B1
(45) Date of Patent: Jul. 17, 2018

(54) FOLDING SHELF SYSTEM

(71) Applicant: Pamella Fell, Scarborough (CA)

(72) Inventor: Pamella Fell, Scarborough (CA)

( * ) Notice: Subject to any disclaimer, the term of this patent is extended or adjusted under 35 U.S.C. 154(b) by 0 days.

(21) Appl. No.: 15/589,880

(22) Filed: May 8, 2017

(51) Int. Cl.
*A45C 13/00* (2006.01)
*A45C 13/02* (2006.01)
*A47B 43/00* (2006.01)
*A45C 5/14* (2006.01)

(52) U.S. Cl.
CPC ..... *A45C 13/004* (2013.01); *A45C 13/02* (2013.01); *A45C 5/14* (2013.01); *A45C 2013/026* (2013.01); *A47B 43/00* (2013.01)

(58) Field of Classification Search
CPC ..... A45C 13/004; A45C 13/02; A45C 5/14; A45C 2013/026; A47B 43/00
USPC ..... 211/59.2
See application file for complete search history.

(56) References Cited

U.S. PATENT DOCUMENTS 327,749 A * 10/1885 Wulff ..... A45C 5/00 190/10
607,539 A * 7/1898 Camp ..... G09F 5/02 190/17
2,967,037 A * 1/1961 Christle ..... A47B 3/02 108/145
4,267,905 A * 5/1981 Stewart ..... A45C 13/02 190/13 R
5,437,367 A * 8/1995 Martin ..... A45C 5/14 190/107
5,647,484 A * 7/1997 Fleming ..... G06F 1/1628 190/109
6,530,475 B1 * 3/2003 Penney ..... A45C 13/02 190/110
7,334,669 B2 2/2008 Barker et al.
7,779,976 B2 8/2010 Mangano
D679,121 S 4/2013 Malone
9,101,187 B2 8/2015 Zheng
9,345,298 B2 5/2016 Bettua et al.
D770,165 S * 11/2016 Music ..... D3/204
2006/0096821 A1 * 5/2006 McKaba ..... A45C 9/00 190/9
2007/0295570 A1 * 12/2007 Campbell ..... A45C 5/14 190/15 R
2010/0276241 A1 11/2010 Malone
2010/0314271 A1 * 12/2010 Baruch ..... A47B 43/00 206/349
2015/0335176 A1 * 11/2015 Piskor ..... A47F 5/10 211/1.3
2016/0066452 A1 * 3/2016 Music ..... B65D 43/163 206/742

* cited by examiner

*Primary Examiner* — Ko H Chan

(57) ABSTRACT

A folding shelf system for storing clothing in an article of luggage includes an article of luggage for storing objects. A shelf unit is selectively positioned in the article of luggage and clothing is selectively positioned on the shelf unit. The shelf unit is selectively positioned in a deployed position to facilitate the clothing to be accessible. The shelf unit is selectively positioned in a folded position such that the shelf unit is contained within the article of luggage.

7 Claims, 4 Drawing Sheets

FOLDING SHELF SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shelf devices and more particularly pertains to a new shelf device for storing clothing in an article of luggage.

BRIEF SUMMARY OF THE INVENTION

An embodiment of the disclosure meets the needs presented above by generally comprising an article of luggage for storing objects. A shelf unit is selectively positioned in the article of luggage and clothing is selectively positioned on the shelf unit. The shelf unit is selectively positioned in a deployed position to facilitate the clothing to be accessible. The shelf unit is selectively positioned in a folded position such that the shelf unit is contained within the article of luggage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
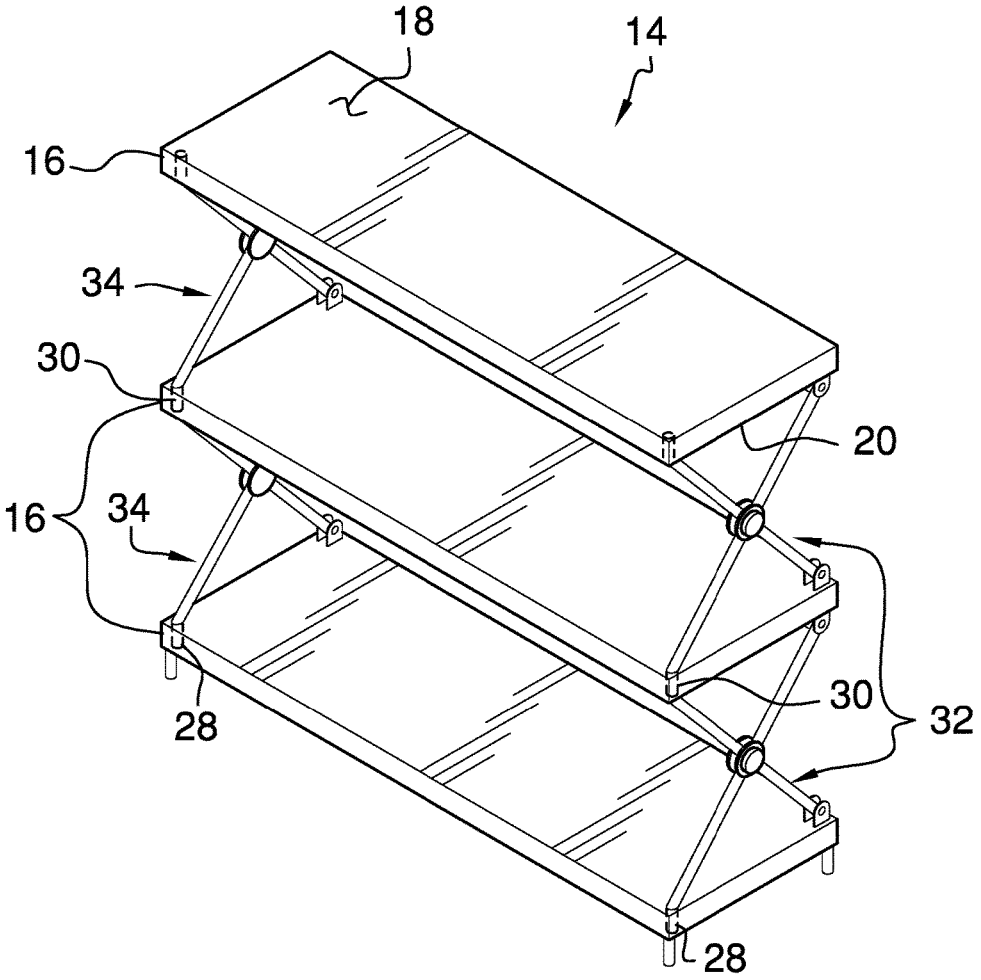
FIG. 1 is a front perspective view of a shelf unit of a folding shelf system according to an embodiment of the disclosure.
Figure 2:
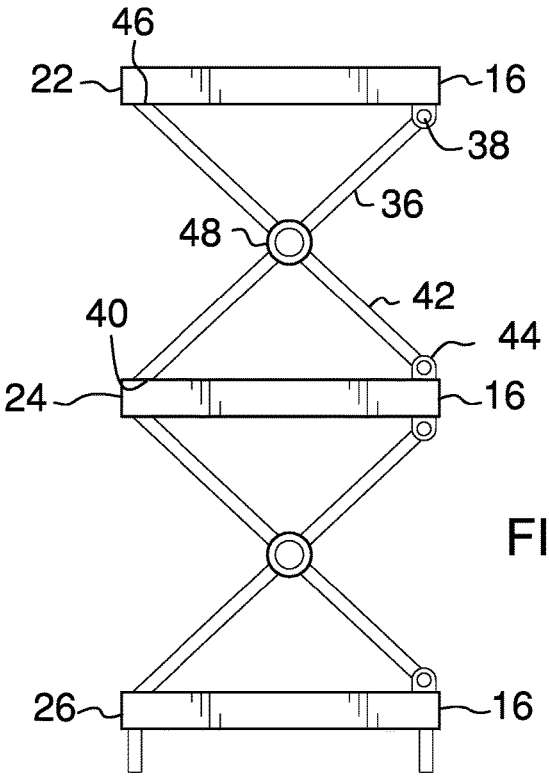
FIG. 2 is a right side view of an embodiment of the disclosure showing a shelf unit in a deployed position.
Figure 3:
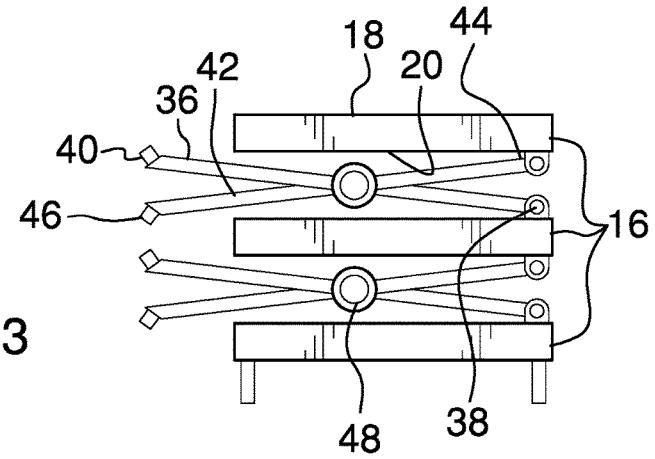
FIG. 3 is a right side view of an embodiment of the disclosure showing a shelf unit in a folded position.
Figure 4:
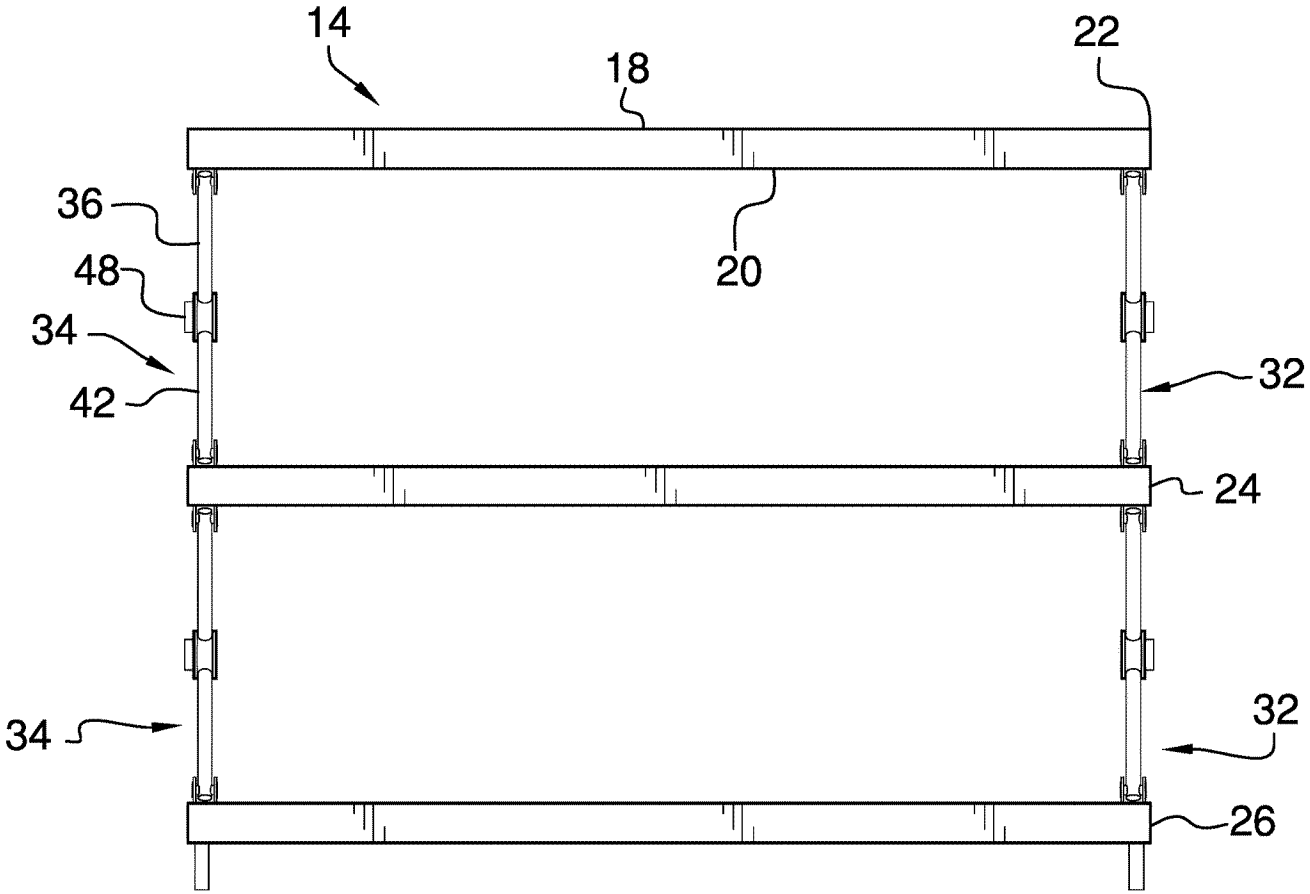
FIG. 4 is a back view of shelf unit of an embodiment of the disclosure.
Figure 5:
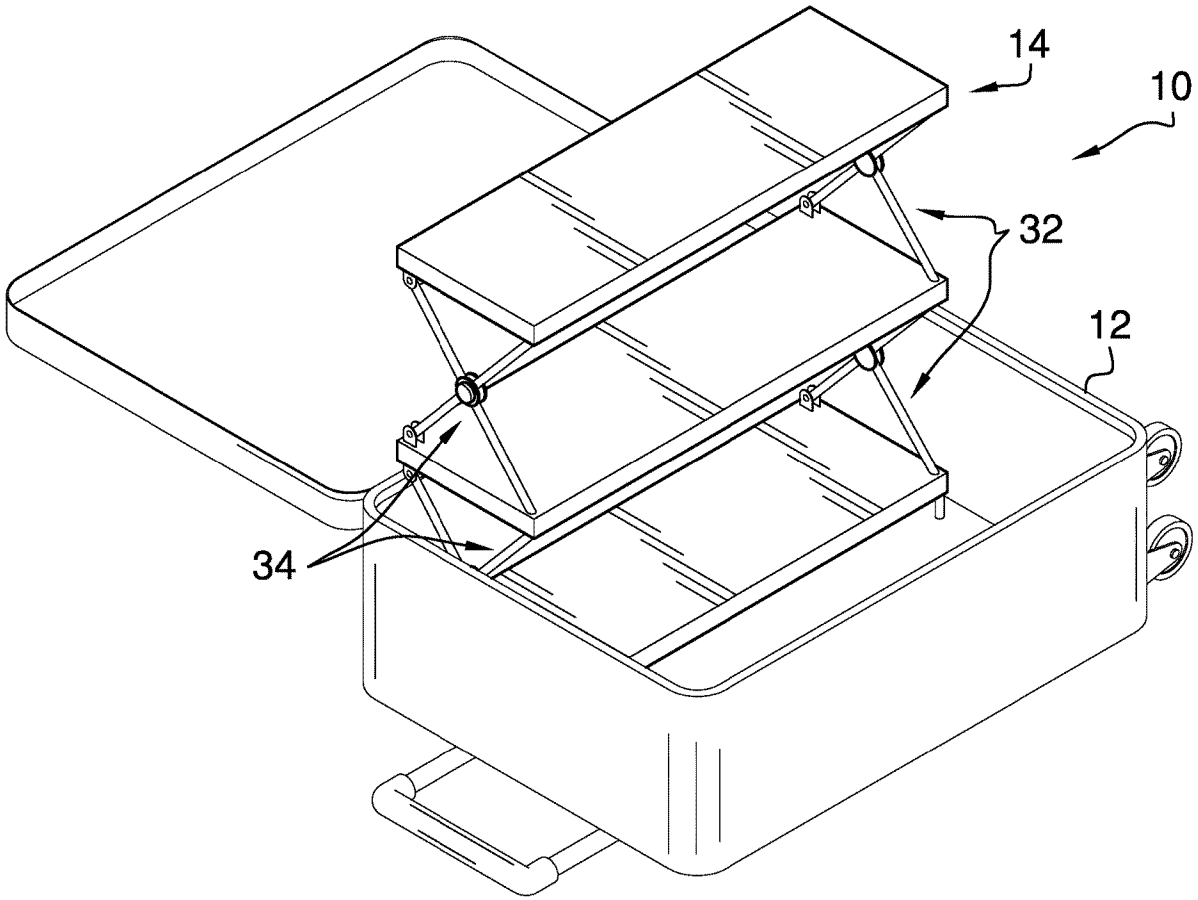
FIG. 5 is a perspective in-use view of an embodiment of the disclosure.

With reference now to the drawings, and in particular to FIGS. 1 through 5 thereof, a new shelf device embodying the principles and concepts of an embodiment of the disclosure and generally designated by the reference numeral 10 will be described.

As best illustrated in FIGS. 1 through 5, the folding shelf system 10 generally comprises an article of luggage 12 for storing objects. The article of luggage 12 may be a suitcase of any conventional design or the like and the objects may be clothing. A shelf unit 14 is selectively positioned in the article of luggage 12 and clothing is selectively positioned on the shelf unit 14. The shelf unit 14 is selectively positioned in a deployed position to facilitate the clothing to be accessible. Moreover, the shelf unit 14 is selectively positioned in a folded position such that the shelf unit 14 is contained within the article of luggage 12 thereby facilitating the article of luggage 12 to be closed.

The shelf unit 14 comprises a plurality of shelves 16 and each of the shelves 16 has a first surface 18 and a second surface 20. The clothing is positioned on the first surface 18 corresponding to each of the shelves 16. The plurality of shelves 16 includes a top shelf 22, a middle shelf 24 and a bottom shelf 26. The first surface 18 corresponding to each of the middle 24 and bottom shelves 26 has a pair of first wells 28 each extending toward the second surface 20. The first wells 28 are spaced apart from each other. Additionally, the second surface 20 corresponding to each of the top 22 and middle 24 shelves has a pair of second wells 30 each extending toward the first surface 18. The second wells 30 are spaced apart from each other.

A pair of first scissors 32 is provided and each of the first scissors 32 is movably coupled between the top shelf 22 and the middle shelf 24. The top shelf 22 is spaced a maximum distance from the middle shelf 24 when the shelf unit 14 is positioned in the deployed position. The top shelf 22 is spaced a minimum distance from the middle shelf 24 when the shelf unit 14 is in the folded position. A pair of second scissors 34 is provided and each of the second scissors 34 is movably coupled between the middle shelf 24 and the bottom shelf 26. The bottom shelf 26 is spaced a maximum distance from the middle shelf 24 when the shelf unit 14 is positioned in the deployed position. Additionally, the bottom shelf 26 is spaced a minimum distance from the middle shelf 24 when the shelf unit 14 is in the folded position.

Each of the first 32 and second 34 scissors includes all of the elements described hereforth, including a first member 36 that has a first end 38 and a second end 40. The first end 38 is hingedly coupled to the second surface 20 of an associated one of the shelves 16. The first well 28 insertably receives the second end 40 when the shelf unit 14 is positioned in the deployed position. A second member 42 is provided that has a primary end 44 and a secondary end 46. The primary end 44 is hingedly coupled to the first surface 18 of an associated one of the shelves 16. Moreover, the second well 30 insertably receives the secondary end 46 when the shelf unit 14 is positioned in the deployed position. The second member 42 intersects the first member 36 at a central position such that the first 36 and second 42 member forms an X.

A lock 48 is coupled to each of the first 36 and second 42 members and the lock 48 is positioned at an intersection between the first 36 and second 42 members. The lock 48 locks each of the first 36 and second 42 members when the shelf unit 14 is positioned in the deployed position. In this way the lock 48 supports a weight of the clothing on the shelves 16 thereby retaining the shelf unit 14 in the deployed position. The lock 48 unlocks each of the first 36 and second 42 members when the shelf unit 14 is positioned in the folded position. The lock 48 may comprise a pair of disks that are each rotatably coupled together and each of the first 36 and second 42 members may be attached to an associated one of the disks. Additionally, the lock 48 may comprise any conventional, mechanical hinged lock 48.

In use, the shelf unit 14 is positioned in the article of luggage 12 and the shelf unit 14 is positioned in the deployed position. The clothing is positioned on each of the shelves 16 and the shelf unit 14 is positioned in the folded position. The article of luggage 12 is closed and the article of luggage 12 is manipulated for travel or the like. The article of luggage 12 is opened and the shelf unit 14 is positioned in the deployed position. Thus, the clothing on each of the shelves 16 is organized and accessible.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A folding shelf system comprising:

an article of luggage being configured to store objects; and a shelf unit being selectively positioned in said article of luggage, said shelf unit being configured to have clothing positioned thereon, said shelf unit being selectively positioned in a deployed position wherein said shelf unit is configured to facilitate the clothing to be accessible, said shelf unit being selectively positioned in a folded position such that said shelf unit is contained within said article of luggage, said shelf unit comprising a plurality of shelves, each of said shelves having a first surface and a second surface, said first surface corresponding to each of said shelves being configured to have the clothing positioned thereon, said plurality of shelves including a top shelf, a middle shelf and a bottom shelf, each of said middle and bottom shelves having a pair of first wells, a pair of first scissors, a pair of second scissors, each of said second scissors being movably coupled between said middle shelf and said bottom shelf, said bottom shelf being spaced a maximum distance from said middle shelf when said shelf unit is positioned in said deployed position, said bottom shelf being spaced a minimum distance from said middle shelf when said shelf unit is in said folded position, and each of said first and second scissors comprises a first member having a first end and a second end, said first end being hingedly coupled to said second surface of an associated one of said shelves, said first well insertably receiving said second end when said shelf unit is positioned in said deployed position.

2. The system according to claim 1, wherein said first surface corresponding to each of said middle and bottom shelves has said pair of first wells each extending toward said second surface, said first wells being spaced apart from each other.

3. The system according to claim 1, wherein said second surface corresponding to each of said top and middle shelves has a pair of second wells each extending toward said first surface, said second wells being spaced apart from each other.

4. The system according to claim 1, further comprising a pair of first scissors, each of said first scissors being movably coupled between said top shelf and said middle shelf, said top shelf being spaced a maximum distance from said middle shelf when said shelf unit is positioned in said deployed position, said top shelf being spaced a minimum distance from said middle shelf when said shelf unit is in said folded position.

5. The system according to claim 1, wherein:

each of said middle and top shelves has a pair of second wells; and a second member having a primary end and a secondary end, said primary end being hingedly coupled to said first surface of an associated one of said shelves, said second well insertably receiving said secondary end when said shelf unit is positioned in said deployed position, said second member intersecting said first member at a central position such that said first and second member forms an X.

6. The system according to claim 5, further comprising a lock being coupled to each of said first and second members, said lock being positioned at an intersection between said first and second members, said lock locking each of said first and second members when said shelf unit is positioned in said deployed position wherein said lock is configured to support a weight of the clothing on said shelves, said lock unlocking each of said first and second members when said shelf unit is positioned in said folded position.

7. A folding shelf system comprising:

an article of luggage being configured to store objects; and a shelf unit being selectively positioned in said article of luggage, said shelf unit being configured to have clothing positioned thereon, said shelf unit being selectively positioned in a deployed position wherein said shelf unit is configured to facilitate the clothing to be accessible, said shelf unit being selectively positioned in a folded position such that said shelf unit is contained within said article of luggage, said shelf unit comprising:

a plurality of shelves, each of said shelves having a first surface and a second surface, said first surface corresponding to each of said shelves being configured to have the clothing positioned thereon, said plurality of shelves including a top shelf, a middle shelf and a bottom shelf, said first surface corresponding to each of said middle and bottom shelves having a pair of first wells each extending toward said second surface, said first wells being spaced apart from each other, said second surface corresponding to each of said top and middle shelves having a pair of second wells each extending toward said first surface, said second wells being spaced apart from each other, a pair of first scissors, each of said first scissors being movably coupled between said top shelf and said middle shelf, said top shelf being spaced a maximum distance from said middle shelf when said shelf unit is positioned in said deployed position, said top shelf being spaced a minimum distance from said middle shelf when said shelf unit is in said folded position, a pair of second scissors, each of said second scissors being movably coupled between said middle shelf and said bottom shelf, said bottom shelf being spaced a maximum distance from said middle shelf when said shelf unit is positioned in said deployed position, said bottom shelf being spaced a minimum distance from said middle shelf when said shelf unit is in said folded position, each of said first and second scissors comprising:

a first member having a first end and a second end, said first end being hingedly coupled to said second surface of an associated one of said shelves, said first well insertably receiving said second end when said shelf unit is positioned in said deployed position, a second member having a primary end and a secondary end, said primary end being hingedly coupled to said first surface of an associated one of said shelves, said second well insertably receiving said secondary end when said shelf unit is positioned in said deployed position, said second member intersecting said first member at a central position such that said first and second member forms an X, and a lock being coupled to each of said first and second members, said lock being positioned at an intersection between said first and second members, said lock locking each of said first and second members when said shelf unit is positioned in said deployed position wherein said lock is configured to support a weight of the clothing on said shelves, said lock unlocking each of said first and second members when said shelf unit is positioned in said folded position.

* * * * *